United States Patent [19]

Levin et al.

[11] Patent Number: 4,612,066

[45] Date of Patent: Sep. 16, 1986

[54] METHOD FOR REFINING MICROSTRUCTURES OF TITANIUM ALLOY CASTINGS

[76] Inventors: Lev Levin, Department of Materials Engineering, Technion-Israel Institute of Technology, Technion City, Haifa 32000, Israel; Russell G. Vogt, 1373 Meadow Bridge Dr., Dayton, Ohio 45432; Daniel Eylon, 7245 Fontella Ct., Dayton, Ohio 45415; Francis H. Froes, 1139 Brewster Dr., Xenia, Ohio 45385

[21] Appl. No.: 758,929

[22] Filed: Jul. 25, 1985

[51] Int. Cl.[4] ..... C22F 1/18

[52] U.S. Cl. ..... 148/20.3; 148/133

[58] Field of Search ..... 148/20.3, 133

[56] References Cited

U.S. PATENT DOCUMENTS 4,482,398 11/1984 Eylon et al. ..... 148/11.5 F

OTHER PUBLICATIONS

F. H. Froes and J. R. Pickens "Powder Metallurgy of Light Metal Alloys for Demanding Applications", Journal of Metals, vol. 36, No. 1, Jan. 1984, pp. 14–28.

*Primary Examiner*—R. Dean

*Attorney, Agent, or Firm*—Donald J. Singer; Charles E. Bricker

[57] ABSTRACT

The microstructure of cast titanium alloy articles is improved by a method which comprises beta solution heat treating the article, followed by hydrogenating and then dehydrogenating the article.

7 Claims, 4 Drawing Figures

METHOD FOR REFINING MICROSTRUCTURES OF TITANIUM ALLOY CASTINGS

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of cast titanium articles to improve the microstructure of such articles.

The major use of titanium castings is in the aerospace, chemical and energy industries. The aerospace applications generally require high performance cast parts, while the chemical and energy industries primarily use large castings where corrosion resistance is a major consideration in design and material choice.

The casting of titanium and titanium alloys presents a special problem due to the high reactivity of the material in the molten state. This requires special melting, mold-making practices, and equipment to prevent alloy contamination. At the same time, titanium castings present certain advantages when compared to castings of other metals. The microstructure of as-cast titanium is desirable for many mechanical properties. It has good creep resistance, fatigue crack growth resistance, fracture resistance, and tensile strength. Titanium alloy castings also readily lend themselves to full densification by hot isostatic pressing (HIP) because they dissolve their own oxides at high temperatures allowing a complete closure of all nonsurface-connected porosity by diffusion bonding. However, on the debit side, some cast-parts mechanical properties, particularly those which are initiation-related, such as smooth fatigue, are currently inferior to those exhibited by ingot metallurgy (IM) parts.

The melting practice used for cast-part production is essentially the same as for alloy ingot melting. Accordingly, it is possible to cast all titanium alloys produced by ingot metallurgy. The major difference between ingot metallurgy and cast metallurgy parts stems from the subsequent hot working and heat treatment of ingots or their products, which allows microstructural manipulations not possible in the cast part, such as, for example, equiaxed recrystallized alpha.

Accordingly, it is an object of the present invention to provide a process for improving the microstructure of a cast titanium article.

Other objects, aspects and advantages of the present invention will become apparent to those skilled in the art after reading the detailed disclosure of the invention as well as the appended claims.

SUMMARY OF THE INVENTION

In accordance with the present invention, there is provided a process for improving the microstructure of a cast titanium article which comprises, in combination, the steps of:

(a) beta-solution heat treating the cast article for a relatively brief time;
(b) quenching the article;
(c) hydrogenating the article; and
(d) dehydrogenating the article.

DETAILED DESCRIPTION OF THE INVENTION

Figure 1:
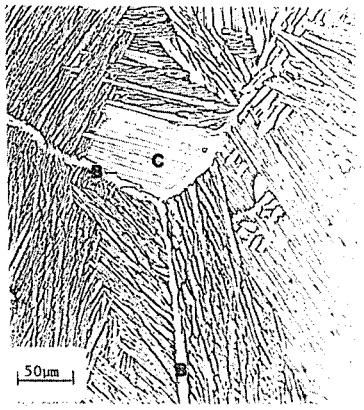
FIG. 1 is a 250× photomicrograph illustrating the structure of as-cast Ti—6Al—4V.

Titanium castings are produced predominantly from the Ti—6Al—4V alloy and various commercially-pure (CP) titanium grades. A number of other alloys have been cast, including Ti—6Al—6V—2Sn, Ti—6Al—2Sn—4Zr—2Mo, Ti—6Al—2Sn—4Zr—6Mo; Ti—6Al—2Sn—2Zr—2Mo—2Cr—0.25Si, Ti—5Al—2.5Sn, Ti—2.5Al—13V—7Sn—2Zr, Ti—10V—2Fe—3Al, and Ti—11.5Mo—6Zr—4.5Sn.

Three types of molds are currently used for casting titanium and its alloys: rammed graphite, ceramic and investment casting. Rammed graphite was the earliest commercial mold-making technique for casting titanium practiced in the United States. Traditionally, a mixture of properly size-fractioned graphite powder, pitch, corn syrup, starch and water is rammed against a wooden or fiberglass pattern to form a mold section. The mold sections are dried, then fired for 24 hours at 1025° C. causing the constituents to carbonize. Mold ramming is a labor intensive process which cannot be easily mechanized. The graphite mold is so hard that it must be chiseled off the cast parts. The castings are generally cleaned in an acid bath, followed if necessary by chemical-milling and weld repair, then sand blasted for good surface appearance.

Ceramic mold sections are generally produced from wood patterns. The ceramic molds are higher in cost than the rammed graphite molds and are more difficult to remove from the cast parts. Ceramic molds are most appropriate for large components requiring accurate dimensions.

Investment casting is adaptable to automation and production of large-quantity runs. In this method, a wax pattern is produced by injection molding. The pattern assembly is dipped in a ceramic slurry, stuccoed and dried. This is repeated several times to build a ceramic shell with sufficient strength to sustain the molding pressure. After drying the wax pattern is removed and the ceramic shell is dried. The ceramic shell is then filled with the titanium molding material, using a suitable molding apparatus. After casting, the ceramic shell is removed.

Following separation of the casting and the mold, the casting may, optionally, be densified by Hot Isostatic Pressing (HIP). Titanium alloys dissolve their own oxides at high temperatures allowing a complete closure of all nonsurface-connected porosity by diffusion bonding. The Hot Isostatic Pressing of titanium and titanium alloys may be carried out at a temperature about 5 to 10 percent below the beta-transus temperature of the alloy (based upon the Celsius scale) at pressures of 700–1000 bars (10–15 Ksi) for 2–4 hours. For example, the Hot Isostatic Pressing of Ti6Al4V, which has a beta-transus of about 1000° C., is typically carried out in the temperature range of 820°–955° C. at about 1000 bars for 4 hours. These conditions are similar to those used for titanium prealloyed powder HIP consolidation. In the case of titanium castings, a can or mold is unnecessary to obtain densification, which makes it a less expensive operation than powder consolidation. Hot Isostatic Pressing can enhance critical mechanical properties such as fatigue resistance, while causing no serious degradation in properties such as fracture toughness, fatigue crack growth rate, and tensile strength.

Hot Isostatic Pressing does not heal surface connected porosity. Therefore, weld repair is a common practice for filling gas porosity, shrinkage pores exposed by chemical milling, post-HIP surface depressions, or cold shuts for applications requiring defect-free components. Inert gas tungsten arc welding is typically used with alloy filler rods of regular or ELI (low-oxygen grade) material, followed by a stress relaxation heat treatment. Weld repair does not have an adverse effect on tensile properties, smooth bar high or low-cycle fatigue, fatigue crack growth rate, fracture toughness, creep rate, or creep rupture strength.

The method of the present invention comprises beta-solution treatment of a cast article, followed by rapid cooling to room temperature, followed by hydrogenation/dehydrogenation of the article. The beta-solution treatment is accomplished by heating the article, in an inert atmosphere of argon, helium, nitrogen, or the like, to approximately the beta-transus temperature of the alloy, i.e., from about 5% to about 10% above the beta-transus temperature (in °C.), followed by rapid cooling. In a presently preferred embodiment, the beta-solution heat treatment is conducted by heating the article to a temperature in the approximate range of 0 to 5% above the beta-transus of the alloy, followed by rapid cooling, such as by water quenching. The period of time over which the article is held at or near the beta-transus temperature can vary from about 10 minutes to about 240 minutes, depending on the cross-section of the article, with thinner articles requiring a shorter holding time. The article can be quenched, i.e. cooled, in a flowing stream of cooled gas, such as air, or in water or oil, with water quenching providing the highest cooling rate and air cooling the slowest. The term "rapid cooling" includes cooling rates between about 10° C./sec and 1000° C./sec.

Following the beta-solution treatment, the article is hydrogenated. Titanium and its alloys have an affinity for hydrogen, being able to dissolve up to about 3 w% (60 atomic %) hydrogen at 590° C. While it may be possible to hydrogenate the article to the maximum quantity, it is presently preferred to hydrogenate the article to a level of about 0.1 to 2.3 weight percent hydrogen.

Hydrogenation is conducted in a suitable, closed apparatus at an elevated temperature by admitting sufficient hydrogen to attain the desired concentration of hydrogen in the alloy. The hydrogenation step is conducted at a temperature of about 50% to 96% of the beta-transus temperature of the alloy. Heating of the article to the desired temperature is conducted under an inert atmosphere. When the hydrogenation temperature is reached, hydrogen is added to the atmosphere within the apparatus. The partial pressure of hydrogen added to the atmosphere and the time required for hydrogenation are dependent upon such factors as the size and cross-section of the article, the temperature of hydrogenation and the desired concentration of hydrogen in the article.

After hydrogenation, the admission of pure hydrogen into the apparatus is discontinued and the apparatus is preferably flushed with a non-flammable mixture of an inert gas and about 4% hydrogen. The article is allowed to equilibrate at the hydrogenation temperature for about 10 to 120 minutes, and then furnace cooled.

Dehydrogenation of the hydrogenated article is accomplished by heating the article, under vacuum, to a temperature in the range given above, i.e., about 50% to 96% of the beta-transus temperature of the alloy. The time for hydrogen removal will depend on the size and cross-section of the article and the volume of hydrogen to be removed. The time for dehydrogenation must be sufficient to reduce the hydrogen content in the article to less than the maximum allowable level. For the alloy Ti—6Al—4V, the final hydrogenation level must be below 120 ppm (0.012 w%) to avoid degradation of the physical properties such as room temperature ductility.

The dehydrogenation step is conducted by heating the article in a vacuum furnace under vacuum to dehydrogenation temperature. The article may be held at dehydrogenation temperature, under vacuum, for about 15 to 60 minutes per one-half inch of cross-section to ensure substantially evolution of hydrogen from the article. Heating is then discontinued and the article is allowed to furnace cool. The phrase "furnace cooling" means that heating is discontinued and the apparatus is allowed to cool to the external ambient temperature. Those skilled in the art will recognize that the rate of such cool down is dependent upon factors such as the construction of the apparatus, atmospheric currents in the surrounding vicinity, etc.; that a well-insulated furnace will cool down at a slower rate than one not well-insulated. The rate of furnace cooling can vary between about 10° and 200° C. per hour. It is presently preferred that the cooling rate be about 50° C. per hour.

The term "vacuum" is intended to mean a vacuum of about $10^{-2}$ mm Hg or less, preferably about $10^{-4}$ mm Hg or less.

The benefits of the method of this invention are illustrated in FIGS. 1–4. A typical microstructure of an article prepared by casting and HIP'ing of Ti—6Al—4V is shown in FIG. 1. The structure constituting regions of high aspect ratio alpha plates separated by a continuous beta phase (reference letter C) as well as continuous grain boundary alpha phase (reference letter B).

Figure 2:
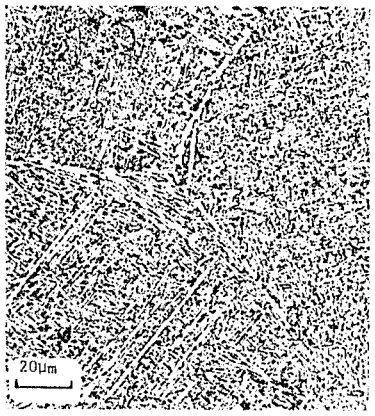
FIG. 2 is a 600× photomicrograph illustrating the structure of cast Ti—6Al—4V following treatment in accordance with the invention.

FIG. 2 illustrates a structure resulting from beta solution treatment/hydrogenation/dehydrogenation in accordance with the present invention. The grain boundary alpha is no longer continuous, the alpha microstructure is much finer than the cast and HIP'd structure is no longer separated by continuous beta phase, the latter being broken up.

Figure 3:
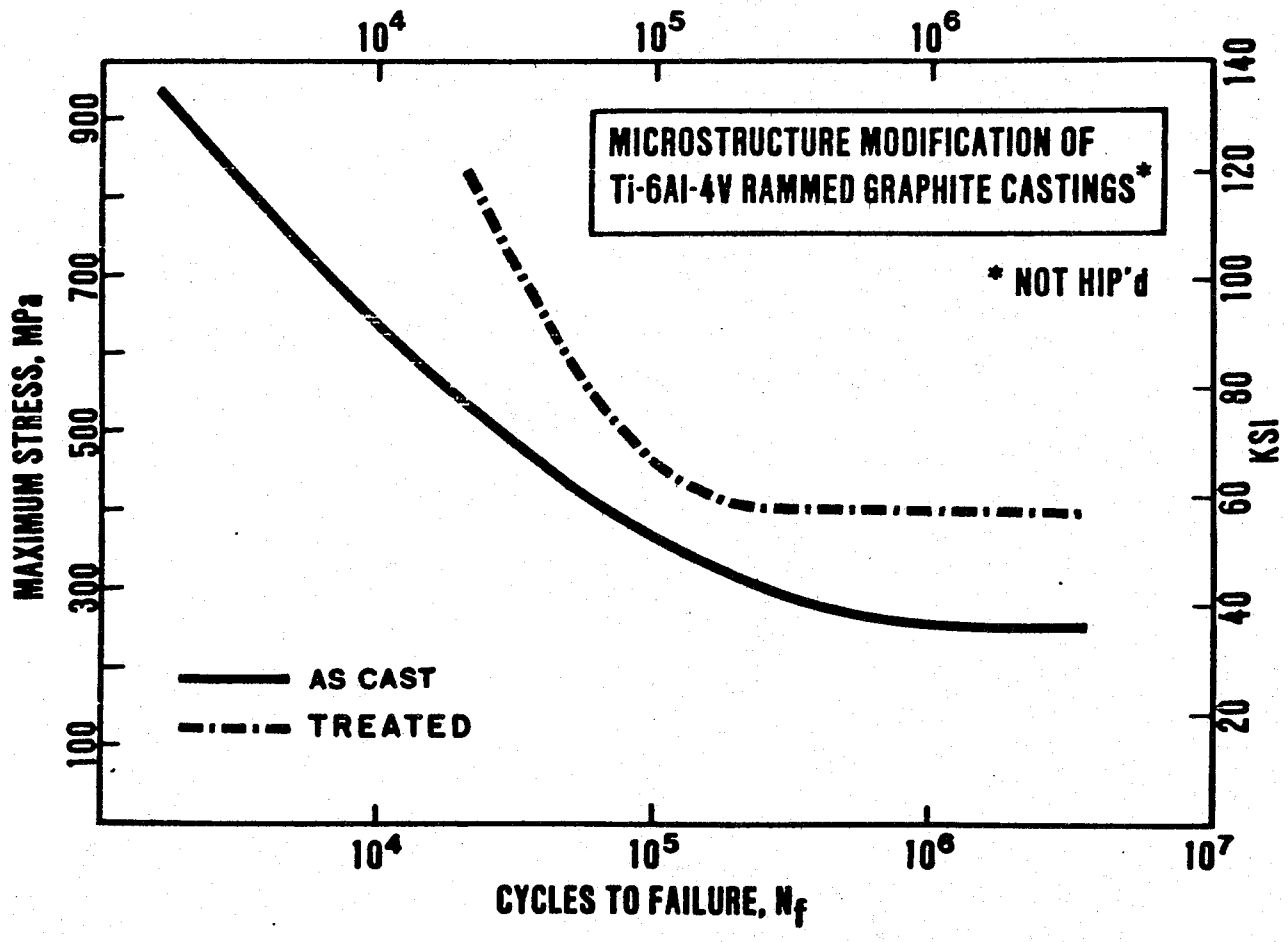
FIG. 3 is a graph illustrating the smooth axial fatigue strength of cast Ti—6Al—4V coupons, both untreated and treated in accordance with the invention.

FIG. 3 illustrates the smooth axial fatigue strength of a series of coupons prepared by casting Ti—6Al—4V. The solid line represents the fatigue data of as-cast material (not HIP'd). The broken line represents the increased fatigue strength of coupons which were treated in accordance with the invention as follows: 1025° C. (1880° F.) for 20 minutes followed by water quench to room temperature followed by hydrogenation at 593° C., followed by dehydrogenation at 593° C.

Figure 4:
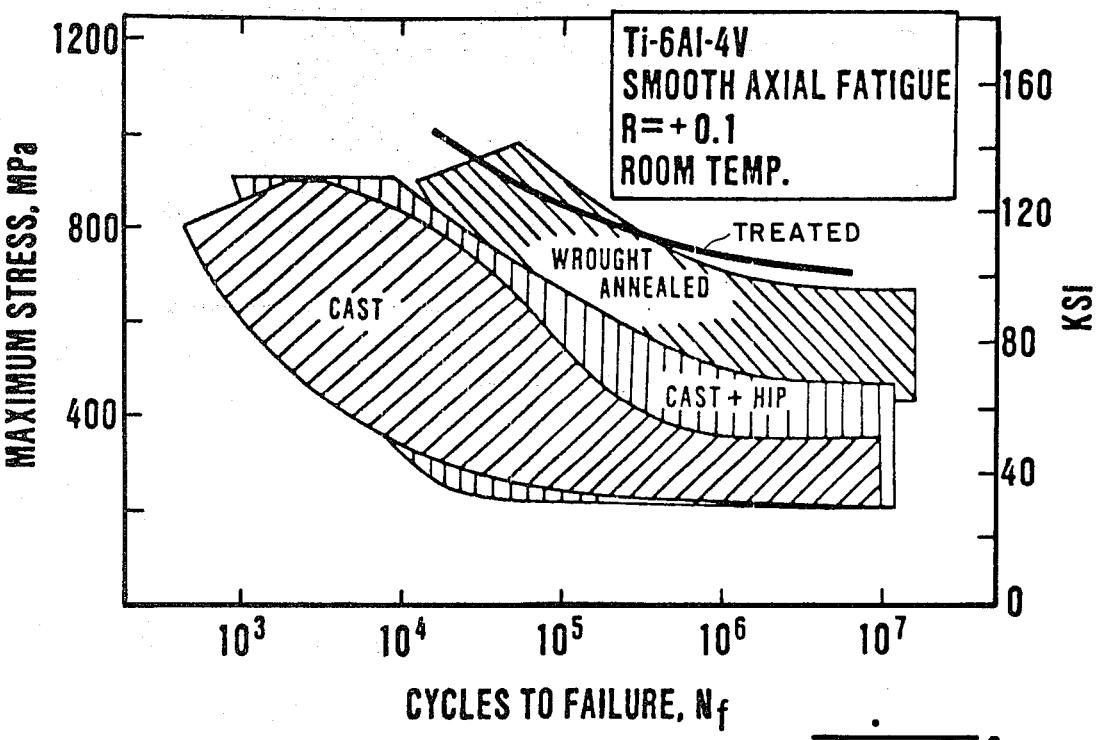
FIG. 4 is a graph illustrating the smooth axial fatigue strength of treated cast Ti—6Al—4V cast coupons versus wrought annealed, untreated cast and hot isostatically pressed cast material.

FIG. 4 illustrates the smooth axial fatigue strength of the series of cast coupons described in the preceding paragraph (solid line) compared to the scatterband of cast, cast+HIP, and wrought annealed material (cross-hatched area).

The method of this invention is generally applicable to the manufacture of aircraft components, as well as non-aerospace components. This method is particularly applicable to the production of fatigue-resistant titanium alloy articles, such as, for example, aircraft engine mount supports, load carrying wing sections and nacelles, turbine engine compressor blades and the like, as well as orthopedic articles for surgical body implantation, such as hip joints.

EXAMPLE

A series of coupons were prepared by casting Ti—6Al—4V. A portion of the coupons were beta solution heat treated at 1025° C. for 20 minutes followed by water quenching, then hydrogenated at 1.4 w% hydrogen at 590° C., then dehydrogenated at 590° C. The tensile properties of the untreated cast coupons are compared to coupons treated in accordance with the invention in the following table:

TABLE

| Material Condition | 0.2% YS, MPa (Ksi) | UTS MPA (Ksi) | EL, % | RA, % |
|---|---|---|---|---|
| Untreated | 841 (122) | 910 (145) | 8 | 16 |
| Treated | 1062 (154) | 1117 (162) | 6 | 9 |

Various modifications may be made to the present invention without departing from the spirit and scope of the invention.

We claim:

1. A method for improving the microstructure of a cast titanium alloy article which comprises, in combination, the steps of:
   a. beta-solution heat treating said article at a temperature approximately equal to the beta-transus temperature of said alloy;
   b. cooling said article at a rate in excess of air cooling to room temperature;
   c. hydrogenating said article at a temperature in the approximate range of 50 to 96% of said beta-transus temperature; and
   d. dehydrogenation said article at a temperature in the approximate range of 50 to 96% of said beta-transus temperature.

2. The method of claim 1 wherein said beta-solution heat treatment is carried out at a temperature ranging from about 5% below to about 10% above said beta-transus temperature for about 10 to 240 minutes.

3. The method of claim 1 wherein said beta-solution heat treatment is carried out at a temperature in the approximate range of 0 to 5% above said beta-transus temperature for about 10 to 240 minutes.

4. The method of claim 1 wherein said dehydrogenation step comprises cooling said article at a rate in the approximate range of 10° to 200° C. per hour.

5. The method of claim 4 wherein said cooling rate is about 50° C. per hour.

6. The method of claim 1 wherein said article is hydrogenated to a hydrogen level of about 0.1 to 2.3 weight percent.

7. The method of claim 1 wherein said alloy is Ti—6Al—4 V and said article is dehydrogenated to a hydrogen level below 0.012 weight percent.

* * * * *